United States Patent [19]

Marzo

[11] Patent Number: 4,785,477

[45] Date of Patent: Nov. 22, 1988

[54] FOREFINGER COMPARTMENT FOR GLOVE

[75] Inventor: Phillip C. V. Marzo, Guelph, Canada

[73] Assignee: Marzo Glove Company Limited, Acton, Canada

[21] Appl. No.: 52,071

[22] Filed: May 21, 1987

[51] Int. Cl.[4] ..... A41D 19/00

[52] U.S. Cl. ..... 2/159; 2/163

[58] Field of Search ..... 2/158, 159, 163 X

[56] References Cited

U.S. PATENT DOCUMENTS

| | | | |
|---|---|---|---|
| 1,680,592 | 8/1928 | Chiles | 2/158 |
| 2,323,136 | 6/1943 | Johanson | 2/158 |
| 2,327,381 | 8/1943 | Wells | 2/158 |
| 4,712,253 | 12/1987 | Chen | 2/163 |

FOREIGN PATENT DOCUMENTS

| | | | |
|---|---|---|---|
| 975328 | 10/1950 | France | 2/163 |

*Primary Examiner*—Henry S. Jaudon

*Attorney, Agent, or Firm*—Fetherstonhaugh & Co.

[57] ABSTRACT

A thermally insulated glove of the type which has a mitt portion and a thumb portion is formed with a forefinger or trigger finger portion which has a finger compartment communicating with the mitt compartment. The finger compartment is proportioned to accommodate and arranged to receive the forefinger of the wearer in use. The forefinger portion is formed from a thin, flexible material such that it will not significantly restrict the dexterity of the forefinger of the wearer in use and will allow the wearer a substantial degree of tactile sensitivity therethrough. The remainder of the glove is formed from a thermal insulation material which substantially restricts the tactile sensitivity of the wearer.

3 Claims, 2 Drawing Sheets

FOREFINGER COMPARTMENT FOR GLOVE

FIELD OF INVENTION

This invention relates to thermally insulated gloves. In particular, this invention relates to gloves which are in the form of thermally insulated mitts.

PRIOR ART

Thermally insulated gloves in the form of mitts are frequently worn by police and security forces in winter. Mitts are more effective in keeping the hand of the wearer warm than conventional five-fingered gloves because they may be made from a heavier thermal insulating material than can normally be used in the manufacture of gloves. Heavily insulated mitts are, however, unsuitable for use by the wearer when the wearer is performing many tasks such as discharging firearms. Gloves which are designed to be worn when discharging a firearm are generally made from a very thin material so as to provide a substantial degree of tactile sensitivity. These gloves, however, do not provide adequate thermal insulation to enable them to be used in colder climates during winter.

Police and security forces are from time to time, required to maintain an outdoor watch under cold and extremely cold conditions which require them to wear thermally insulated gloves. In order to keep their hands sufficiently warm to enable them to effectively operate a firearm, thermally insulated mitts are the preferred form of glove. For the reasons discussed above, these thermally insulated mitts cannot, however, be worn at the time when the firearm is to be discharged and consequently, it is necessary to remove the mitt in order to discharge the firearm. In many instances, there may be a substantial delay between the time that the user is required to take aim and the time when the firearm is eventually discharged. In many situations, even a short delay may subject the official to severe discomfort.

It is an object of the present invention to provide a glove which has the thermal insulation characteristics of a mitt while providing the flexibility and tactile sensitivity to at least one finger which is comparable to that which can be obtained by a thin, flexible glove.

It is a further object of the present invention to provide a glove which has a mitt compartment and a forefinger compartment which communicates with the mitt compartment so that the wearer can transfer its forefinger from the mitt compartment to the forefinger compartment without moving the glove.

SUMMARY OF THE INVENTION

According to one aspect of the present invention, there is provided in a glove of the type having a mitt portion and a thumb portion made from a thermal insulation material which substantially restricts the tactile sensitivity of the wearer, the mitt portion having a mitt compartment proportioned to accommodate the hand and all four fingers of the wearer, the thumb portion having a thumb compartment proportioned to accommodate the thumb of the wearer, the improvement of a forefinger portion having a forefinger compartment communicating with the mitt compartment, said forefinger compartment being proportioned to accommodate and arranged to receive the forefinger of the wearer in use, said forefinger portion being formed from thin flexible material such that it will not significantly restrict the dexterity of the forefinger of the wearer in use and will allow the wearer a substantial degree of tactile sensitivity therethrough.

PREFERRED EMBODIMENT

The invention will be more clearly understood with reference to the following detailed specification read in conjunction with the drawings wherein;

FIG. 1 of the drawings is a pictorial view of a glove constructed in accordance with an embodiment of the present invention.

Figure 1:
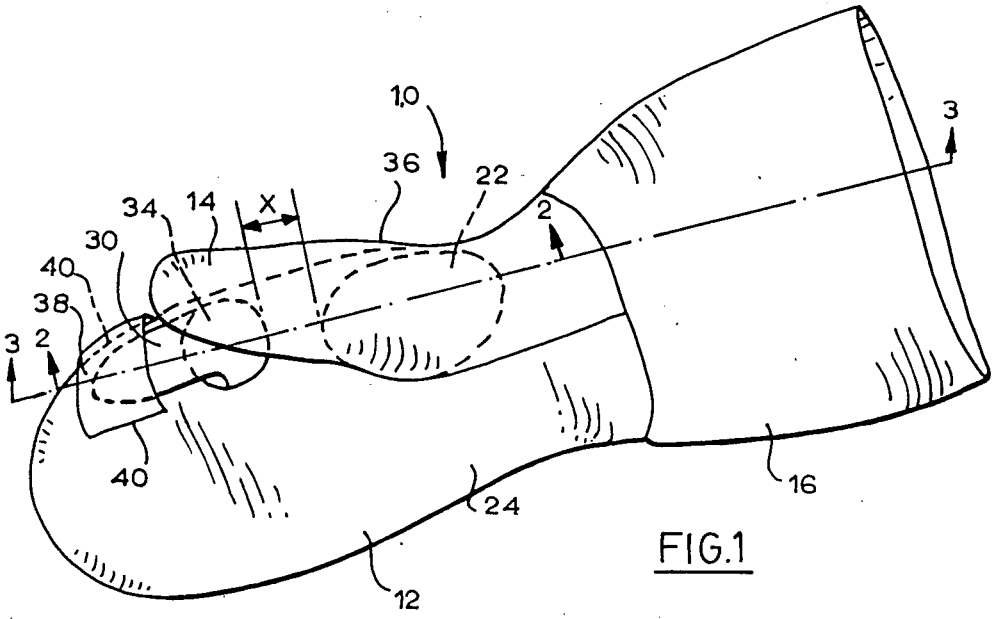

With reference to FIG. 1 of the drawings, the reference numeral 10 refers generally to a glove constructed in accordance with an embodiment of the present invention. The glove 10 includes a mitt portion 12, a thumb portion 14 and a cuff portion 16.

Figure 2:
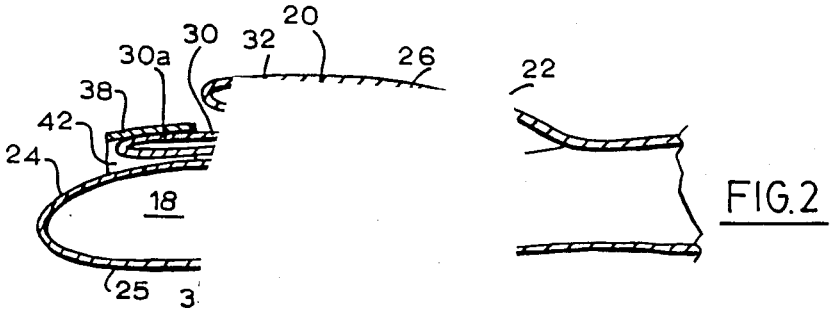
FIG. 2 is a sectional view taken along the line 2—2 of FIG. 1.

As shown in FIG. 2 of the drawings, the mitt portion 12 has a mitt compartment 18 formed between the front panel or palm 24 and the back panel 25. The thumb portion 14 has a thumb compartment 20 which communicates with the mitt compartment 18 through an opening 22 which is formed in the palm 24 of the mitt portion 12. The mitt compartment 18 is proportioned to accommodate the hand and all four fingers in a loose free-fitting relationship of the wearer in use. The thumb compartment 20 is proportioned to accommodate the thumb of the wearer.

The material from which the mitt portion 12 and thumb portion 14 is made may be any conventional thermal insulating material such as deer skin or the like lined with a wool lining or the like to form a laminate. The glove may also be manufactured in a conventional manner as for example, by stitching several panels together to form and interconnect the mitt portion, thumb portion and cuff portion.

The glove which has been described in the preceding paragraphs will serve to keep the wearer's hand warm but will also severely restrict the extent to which the wearer can manipulate various pieces of equipment. In particular, the glove of this type would have to be removed to permit the wearer to pull the trigger of a firearm.

In order to overcome this difficulty, a trigger finger or forefinger portion 30 is provided. The forefinger portion 30 is formed with a forefinger compartment 32 which is proportioned to accommodate the forefinger of the wearer in a close-fitting relationship.

The forefinger compartment 32 communicates with the mit compartment 18 through an opening 34 which is formed in the palm 24. The forefinger portion 30 is formed from a thin, flexible material such as deer skin which will not significantly restrict the dexterity and tactile sensitivity of the forefinger of the wearer in use.

Because the forefinger compartment is made from a material which does not provide the same degree of thermal insulation as the remainder of the glove, the wearer will normally keep all four fingers in the mitt compartment 18 in order to keep the hand warm and will only transfer the forefinger from the mitt compartment to the forefinger compartment 32 of the forefinger portion when necessary to perform a particular task. A feature of the glove of the present invention is that both the thumb opening 22 and the forefinger opening 34 are formed in the palm 24 along a marginal edge portion which extends inwardly from the side edge 36. This ensures that the forefinger opening 34 is accessible to the forefinger of the wearer when the wearer's thumb is positioned in the thumb compartment and the other four fingers are located in the mitt compartment 18.

In order to permit the wearer to transfer his forefinger from the mitt compartment 18 into the forefinger compartment 32 without requiring the wearer to even partially withdraw the hand or other fingers from the mitt compartment, the forefinger opening 34 is spaced from the thumb opening 22 such that the distance between the crotch 26 of the thumb and the adjacent edge 34*a* is a distance "X" which is less than a distance "Y" (FIG. 3) between the first and second knuckles of the forefinger of the wearer. It will be understood that these dimensions will vary depending upon the size of the hand which the glove is proportioned to accommodate. In addition, in order to facilitate the transfer of the forefinger, the forefinger opening 34 is proportioned so as to be substantially larger than that required to permit the wearer's forefinger to pass therethrough. With this arrangement it is possible for the wearer to transfer his forefinger from the mitt compartment without having to adjust the position of the remainder of his hand relative to the mitt compartment. It will also be apparent that manipulation can be carried out without requring the wearer to use his other hand or any other part of his body to hold or retain the glove while the finger manipulation is being carried out.

As shown in FIG. 1 of the drawings, when the forefinger portion 30 is not in use, it is retained in close proximity to the palm 18 by means of a retaining strap 38. The retaining strap 38 is in the form of a narrow band of material which is secured with respect to the palm 24 along opposite side edges 40. The retaining strap 38 serves to form a pocket 42 in which the distal end 30*a* of the forefinger portion 30 extends so as to be retained by the retaining strap 38 in the storage position shown in FIGS. 1 and 2 of the drawings.

Figure 3:
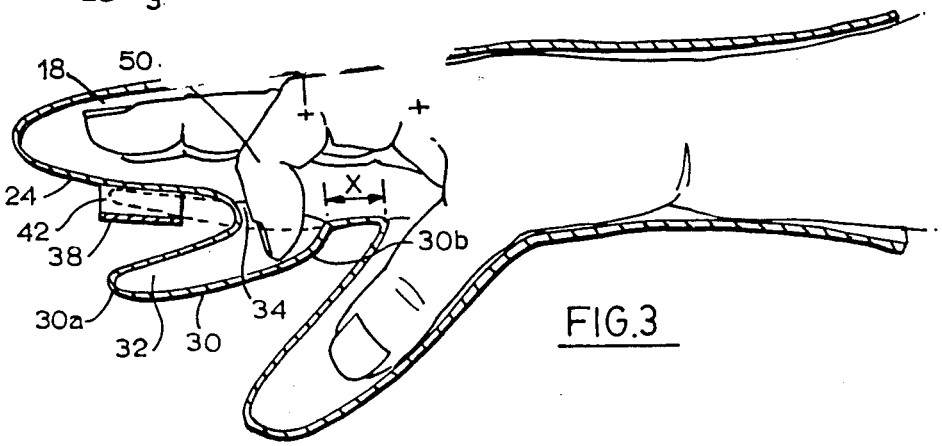
FIG. 3 is a sectional view taken along the line 3—3 of FIG. 1 showing the forefinger portion withdrawn from the retainer.

As shown in FIG. 3 of the drawings, when the wearer wishes to move its forefinger 50 from the mitt compartment 18 into the forefinger compartment 32, it is merely necessary to bend the forefinger toward the opening 34. When contact is made between the forefinger 50 and the proximal end 30*b* of the forefinger portion 30, the pressure applied by the forefinger will serve to draw the distal end 32 out of the pocket 42 to release it from the retainer strap 38. It is then possible for the wearer to insert the forefinger into the forefinger compartment 32 with ease without the need to remove the glove.

Figure 4:
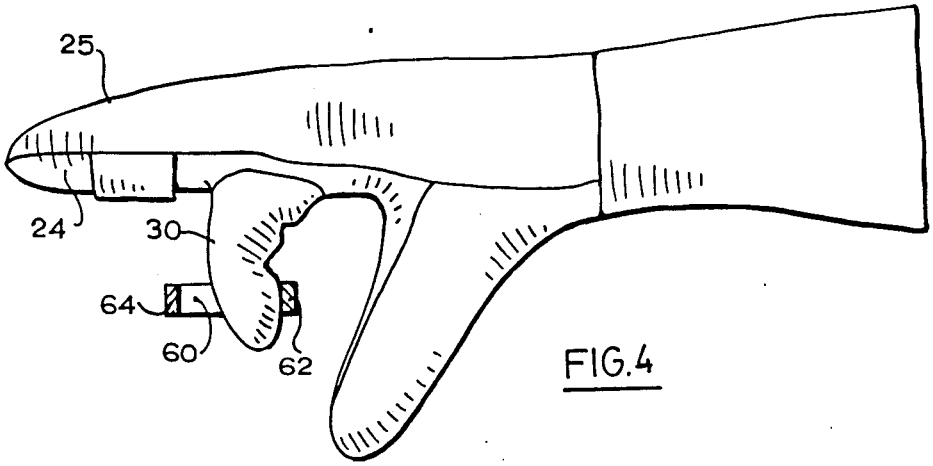
FIG. 4 is a side view of the glove showing the finger portion operably positioned with respect to the trigger of a gun.

As shown in FIG. 4 of the drawings, the forefinger portion 30 is sufficiently thin and flexible to permit the wearer to insert the gloved forefinger into the opening 60 formed between a trigger 62 and a trigger guard 64 of a gun.

As previously indicated, by making the finger portion 30 from a thin flexible material such as deer skin, the wearer may be able to exercise a substantial degree of dexterity and may also enjoy a substantial degree of tactile sensitivity therethrough.

Various modifications of the glove of the preferred embodiment will be apparent to those skilled in the art without departing from the scope of the invention. For example, additional finger portions may be provided for accommodating one or more of the other fingers of the wearer. In a further modification, the trigger finger portion 30 may be designed, proportioned and located to accommodate the second, third or fourth finger of the hand of the wearer as required in use.

It will also be apparent that the glove may be formed without a cuff portion and the thermal liner may be made so as to be removable from the mit portion. In addition, the thermal liner may be made from any suitable thermal insulating material and is not limited to a wool liner.

In addition, it will be apparent that while a straight thumb of the type illustrated in the drawings of the present application has certain advantages in that it provides a good degree of forefinger to thumb dexterity, the present invention is applicable to gloves having a chopper thumb, a wing thumb or a butterfly thumb or the like.

While the glove illustrated in the drawings is a right hand glove, it will be apparent that both right and left hand gloves may be constructed in accordance with the present invention.

It will also be apparent that the material from which the thermally insulated portion of the glove is made may be any conventional material used to manufacture thermally insulated gloves. In addition, while it has been found that deer skin provides a very high degree of flexibility and tactile sensitivity, other materials may be used in the construction of the forefinger portion provided such materials are capable of providing the degree of flexibility and tactile sensitivity required to permit the wearer to perform the required task.

I claim:

1. In a glove of the type having a mitt portion and a thumb portion made from a thermal insulation material which substantially restricts the tactile sensitivity of the wearer, the mitt portion having a mitt compartment proportioned to accommodate the hand and all four fingers of the wearer, the mitt portion having a proximal end and a distal end, a hand access passage opening into the mitt compartment through said proximal end, the thumb portion having a thumb compartment proportioned to accommodate the thumb of the wearer, a forefinger portion having a forefinger compartment communication with the mitt compartment, said forefinger compartment being proportioned to accommodate and arranged to receive the forefinger of the wearer in use, said forefinger portion being formed from thin flexible material such that it will not significantly restrict the dexterity of the forefinger of the wearer in use and will allow the wearer a substantial degree of tactile sensitivity therethrough, the mitt portion having a palm portion, the forefinger compartment communicating with the mitt compartment through a finger opening formed in the palm portion, the improvement wherein said forefinger portion is attached to the palm portion in such a manner that it will normally assume a relaxed position in which it extends from the finger opening toward the distal end of the mitt in an outwardly overlying face-to-face relationship with respect to the palm portion, and forefinger retaining means on the palm portion the glove for releasably retaining the forefinger portion against the palm of the glove, in said face-to-face relationship when not in use.

2. A glove as claimed in claim 1, wherein said forefinger retaining means is in the form of a retaining loop which is arranged to receive the distal end of the forefinger portion, said loop being spaced from the proximal end of the finger compartment a sufficient distance to permit the finger portion to be automatically withdrawn therefrom as the wearer manipulates a forefinger into forefinger compartment in use.

3. In a glove of the type having a mitt portion and a thumb portion made from a thermal insulation material which substantially restricts the tactile sensitivity of the wearer, the mitt portion having a mitt compartment proportioned to accommodate the hand and all four fingers of the wearer, the thumb portion having a thumb compartment proportioned to accommodate the thumb of the wearer, the improvement of a forefinger portion having a forefinger compartment communicating with the mitt compartment, said forefinger compartment being proportioned to accommodate and arranged to receive the forefinger of the wearer in use, said forefinger portion being formed from thin flexible material such that it will not significantly restrict the dexterity of the forefinger of the wearer in use and will allow the wearer a substantial degree of tactile sensitivity therethrough, the mitt portion having a palm portion and the forefinger compartment projects from the palm portion, said forefinger compartment communicating with the mitt compartment through a finger opening formed in the palm portion, the thumb portion projecting from the palm portion toward the distal end of the glove to form a thumb crotch between the thumb portion and the palm portion, said thumb compartment communicating with the mitt compartment through a thumb opening formed in the palm portion, the forefinger opening being spaced from the thumb opening by a distance which will permit the wearer to withdraw their forefinger from the mitt compartment and insert it into the forefinger compartment without adjusting the position of the hand of the wearer with respect to the glove in use, forefinger retaining means being provided on the palm portion of the glove to releaseably retain the forefinger housing against the palm of the glove when not in use, said forefinger retaining means being in the form of a retaining loop which is arranged to receive the distal end of the forefinger portion, said loop being spaced from the proximal end of the finger compartment a sufficient distance to permit the finger portion to be automatically withdrawn therefrom as the wearer manipulates a forefinger into forefinger compartment in use.

* * * * *